US010947631B2

(12) United States Patent
Proshkin et al.

(10) Patent No.: US 10,947,631 B2
(45) Date of Patent: Mar. 16, 2021

(54) METHOD FOR LINING A CATHODE OF A REDUCTION CELL FOR PRODUCTION OF PRIMARY ALUMINUM

(71) Applicant: United Company RUSAL Engineering and Technology Centre LLC, g. Kransoyarsk (RU)

(72) Inventors: Aleksandr Vladimirovich Proshkin, g. Krasnoyarsk (RU); Vitalij Valer'evich Pingin, g. Krasnoyarsk (RU); Gennadij Efimovich Nagibin, g. Krasnoyarsk (RU); Andrej Gennad'evich Sbitnev, g. Krasnoyarsk (RU)

(73) Assignee: United Company Rusal Engineering and Technology Centre LLC, Krasnoyarsk (RU)

( * ) Notice: Subject to any disclaimer, the term of this patent is extended or adjusted under 35 U.S.C. 154(b) by 68 days.

(21) Appl. No.: 16/076,598

(22) PCT Filed: Dec. 30, 2016

(86) PCT No.: PCT/RU2016/000953
§ 371 (c)(1),
(2) Date: Aug. 8, 2018

(87) PCT Pub. No.: WO2017/138843
PCT Pub. Date: Aug. 17, 2017

(65) Prior Publication Data

US 2019/0048484 A1 Feb. 14, 2019

(30) Foreign Application Priority Data

Feb. 9, 2016 (RU) ..... RU2016104190

(51) Int. Cl.
*C25C 3/06* (2006.01)
*C25C 3/08* (2006.01)

(52) U.S. Cl.
CPC ..... *C25C 3/085* (2013.01)

(58) Field of Classification Search
CPC .. C25C 3/08; C25C 3/06; C25C 3/085; C25C 3/16; C25C 7/025; C25C 3/10
See application file for complete search history.

(56) References Cited

U.S. PATENT DOCUMENTS 3,457,149 A * 7/1969 Johnson ..... C25C 3/08 205/379

FOREIGN PATENT DOCUMENTS

RU 2385972 C1 4/2010
RU 2593247 C1 * 8/2016

* cited by examiner

*Primary Examiner* — Zulmariam Mendez
(74) *Attorney, Agent, or Firm* — Hogan Lovells US LLP

(57) ABSTRACT

The present invention relates to nonferrous metallurgy, in particular to the process equipment for electrolytic production of primary aluminum, namely to methods for lining cathode assemblies of reduction cells. A method for lining a cathode of a reduction cell for production of aluminum includes filling a cathode device shell with a thermal insulation layer and leveling said layer; filling, leveling and compacting a refractory layer; installing bottom and side blocks followed by sealing joints therebetween with a cold ramming paste. Prior to filling a shell bottom with the thermal insulation layer, a layer of fine carbonized particles is formed. The inventive method for lining a cathode assembly of a reduction cell for production of primary aluminum allows to reduce the cost of lining materials and energy consumption for reduction cell operation by means of improved heat resistance of a base and to increase the service life of reduction cells.

3 Claims, 2 Drawing Sheets

METHOD FOR LINING A CATHODE OF A REDUCTION CELL FOR PRODUCTION OF PRIMARY ALUMINUM

This application is a U.S. National Phase under 35 U.S.C. § 371 of International Application PCT/RU2016/000953, filed on Dec. 30, 2016, which claims priority to Russian application 2016104190, filed on Feb. 9, 2016. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

The present invention relates to nonferrous metallurgy, in particular to the process equipment for electrolytic production of primary aluminum, namely to methods for lining cathode assemblies of reduction cells.

It is known a method for lining a cathode part of a reduction cell (RU Pat. No. 2221087, IPC C25C 3/08, published on Oct. 1, 2004) which includes applying a fire-resistant layer made of a dismantled refractory lining of reduction cells in the form of a powder having fraction size of 2-20 mm onto a thermal insulation layer formed of highly porous graphite or coked cellular material having a corrosion rate in an aluminum melt and a cryolite-alumina melt of no more than 0.03 and 0.05 mm/day.

The drawback of such lining method is in low heat-resistance of materials under the cathode in the reduction cell, which is caused by the fact that a thermal conductivity coefficient of porous graphite with a density of 180-200 kg/m3 is 0.174-0.48 Wt/(m·K) which is 2-4 times higher than a thermal conductivity coefficient of conventional thermal insulation materials. Another drawback is a high price of porous graphite.

The closest to the claimed method in terms of its technical features is a method for lining a cathode assembly of a reduction cell for production of aluminum which comprises filling a cathode assembly shell with a thermal insulation layer consisting of non-graphitic carbon or an aluminosilicate or aluminous powder and pre-mixed with non-graphitic carbon; forming a fire-resistant layer by filling with an aluminous powder followed by its vibro-compaction to obtain an apparent porosity no more than 17%; installing bottom and side blocks followed by sealing joints therebetween with a cold ramming paste (RU Patent 2385972, IPC C25C3/08, published on Oct. 4, 2010).

The drawback of such lining method is in that it is accompanied by intensive heat losses through the bottom of the reduction cell due to a high thermal conductivity coefficient of compacted layers of non-graphitic carbon or an aluminosilicate or aluminous powder pre-mixed with non-graphitic carbon leading to increased energy consumption.

The main idea of the present invention is to provide a lining method which would help to reduce energy consumption for reduction cell operation and to reduce purchase costs of used lining materials and to reduce its waste amount to be disposed of.

The object of the present invention is to provide improved thermal and physical characteristics of lining materials of a reduction cell base, reduce costs for purchasing such materials and the amount of waste to be disposed of after dismantling of this reduction cell and to reduce a bottom temperature.

Said technical effect can be achieved by that in the method for lining a cathode of a reduction cell for production of aluminum, which includes filling a cathode device shell with a thermal insulation layer and leveling said layer; filling, leveling and compacting a refractory layer: installing bottom and side blocks followed by sealing joints therebetween with a cold ramming paste, prior to filling a shell bottom with the thermal insulation layer, a layer of fine carbonized particles is formed.

The inventive method is completed with specific features helping to achieve the claimed technical effect.

The layer of fine carbonized particles can be compacted to a height of 5-25% of a height of a space under the cathode in order to obtain a density from 250 to 600 kg/m3, respectively, and woodflour or hard- or softwood sawdust can be used as fine carbonized particles.

Specific embodiments of the present invention described above are not intended to be exhaustive. There are different modifications and improvements which fall within the scope of the invention defined in the claim 1.

A comparative analysis of the features of the claimed solution and the features of the analog and prototype has shown that the solution meets the "novelty" requirement.

The essence of the invention will be better understood upon studying following drawings.

When non-shaped materials are used to install cathode assemblies, compaction of a thermal insulation layer together with a refractory layer leads to compaction of both upper and lower layers and the thermal conductivity coefficient thereof is increased. A layer of fine carbonized particles, such as woodflour particles, makes the space under the cathode more heat resistant because a thermal conductivity coefficient of woodflour is lower than that of partially carbonized lignite. Moreover, providing an elastic layer of fine carbonized particles (FCPs) directly on a bottom of a cathode assembly contributes to the reduction of the relative shrinkage of thermal insulation layers arranged above.

Figure 1:
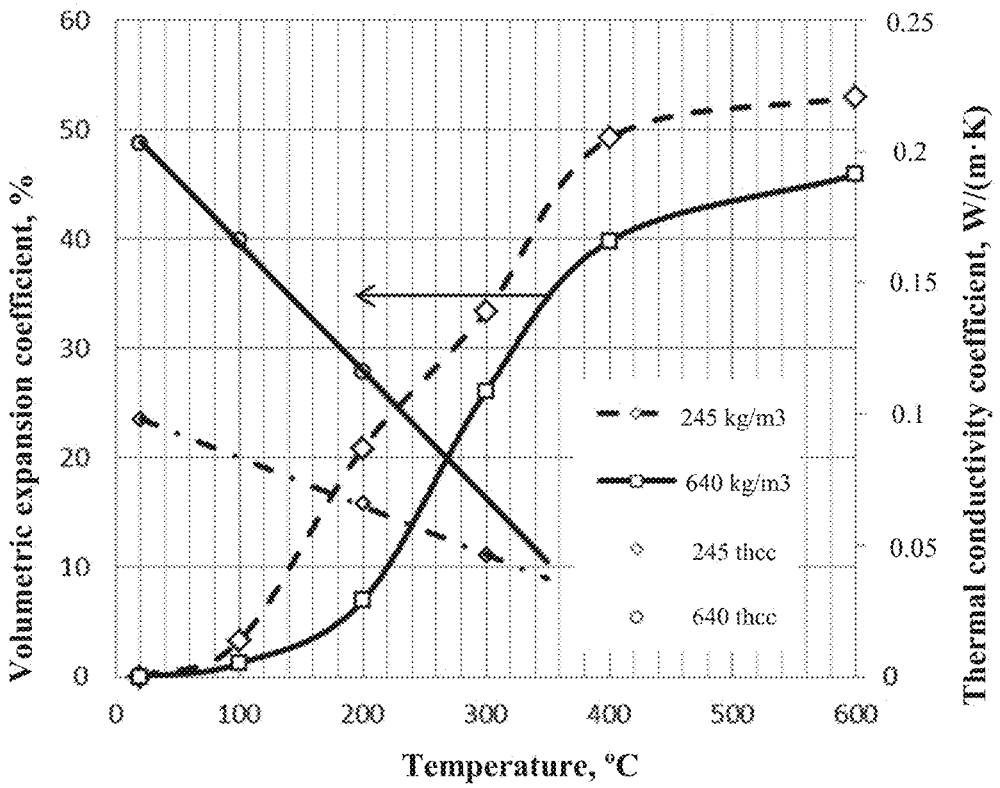
FIG. 1 shows findings concerning the impact of carbonization temperature on a relative volumetric shrinkage and a thermal conductivity coefficient of woodflour having different densities.
Figure 2:
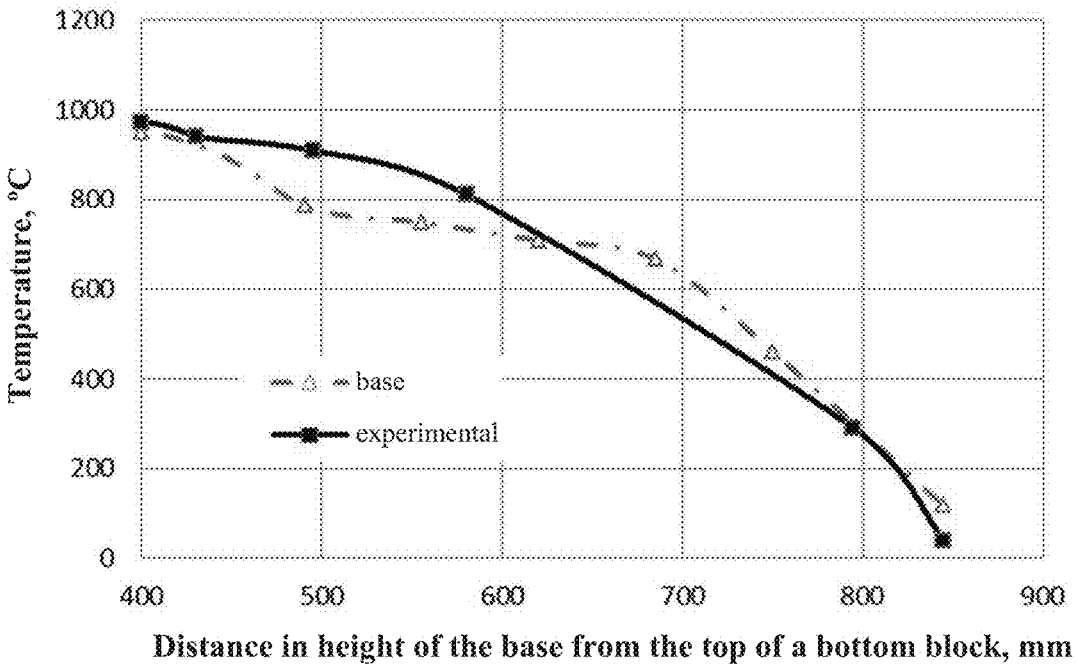
FIG. 2 shows calculation results for temperatures in a reduction cell bottom for production of primary aluminum.\

Parameters of heights and densities of FCPs layers according to the present invention are optimal. As can be seen in FIGS. 1 and 2, incompletely compacted fine carbonized particles creating a layer height of more than 25% of the total height of the space under the cathode increase the risk of compaction of the FCPs layer and structural elements arranged above, as well as the reduction cell breakdown. The over-compacted FCPs resulting in a layer height less than 5% of the total height of the space under the cathode increase a thermal conductivity coefficient and reduce the technical effect which is caused by the low heat resistance.

Experiments on the compaction process and compacted material behavior were carried out using a laboratory bench. The packed density of FCPs was 76 kg/m3. Fractional composition of FCPs is shown in Table 1.

TABLE 1

| Particle size, mm | +2 | −2/+1 | −1/+0.63 | −0.63/+0.315 | −0.315/+0.1 | −0.1 |
|---|---|---|---|---|---|---|
| Percentage, % | 23.15 | 24.95 | 9.55 | 26.85 | 14.85 | 0.65 |

The pyrolysis reaction of FCPs was carried out in a reducing environment (in the filling of partially carbonized lignite) during 7 hours at different temperature values (from 200 to 800° C.). For pyrolysis purposes, samples were compacted to obtain the densities of 245 kg/m3 and 640 kg/m3, and the filling height for such compaction rate was reduced in 3.2 and 8.42 times, respectively.

These researches have shown significant shrinkage of samples at pyrolysis temperatures above 300° C. The strength of the samples was significantly reduced too, and at the pyrolysis temperatures above 400° C. it was no more than 0.3 MPa. In addition, the higher rate of FCPs compaction reduces the relative shrinkage which is more obvious at pyrolysis temperatures of no more than 200° C. Generally, according to the experimental results the following conclusions can be made:

for hard wood materials a thermal conductivity coefficient is higher than for soft wood materials;

at higher pyrolysis temperatures FCPs thermal conductivity is lower;

fine wood materials (e.g., woodflour) have lower thermal conductivity values than more coarse FCPs (−5 mm).

At the maximum compaction rate (640 kg/m3) a thermal conductivity coefficient is 0.203 W/(m·K). However, when pyrolysis temperature is about 200° C., the thermal conductivity is lowered to 0.116 W/(m·K). Accordingly, the use of fine carbonized materials within non-shaped materials under a thermal insulation layer will be highly efficient.

Moreover, additional experiments were carried out where the use was made of compaction rates which can be achieved during reduction cell lining Results for FCPs of various origins and particle sizes are shown in Table 2.

TABLE 2

| No | FCPs type | Packed density, kg/m$^3$ | Compaction coefficient | Relative shrinkage under pressure of 1.5 MPa, % |
|---|---|---|---|---|
| 1 | Soft wood (−5 mm) | 161 | 2 | 15 |
| 2 | Soft wood (woodflour) | 172 | | 27 |
| 3 | Hard wood (−5 mm) | 160 | | 19 |
| 4 | Hard wood (woodflour) | 191 | | 20 |

At the compaction coefficient equal 2 the lowest compaction (of 15%) have demonstrated soft wood FCPs. This value is a little bit higher than the desired compaction rate under the pressure of 1.5 MPa (10%). To obtain the desired compaction rate (less than 10%) a compaction coefficient has to be increased up to 2.2.

The advantage of soft wood FCPs under satisfactory thermal and physical characteristics is in its affordability.

Industrial tests for the said method for lining with non-shaped materials of reduction cells have confirmed the main principles of the inventive method.

The inventive method for lining a cathode assembly of a reduction cell for production of primary aluminum allows, in comparison to the prototype, to reduce the cost of lining materials and energy consumption for reduction cell operation by means of improved heat resistance of a base and to increase the service life of reduction cells.

The invention claimed is:

1. A method for lining a cathode of a reduction cell for production of aluminum, the method comprising:

filling a bottom of a cathode device shell with a layer of fine carbonized particles, wherein the fine carbonized particles consist of carbonized woodflour, carbonized hardwood sawdust, or carbonized softwood sawdust;

filling and leveling a thermal insulation layer on the layer of fine carbonized particles;

filling, leveling and compacting a refractory layer; and installing bottom and side blocks followed by sealing joints therebetween with a cold ramming paste, wherein the fine carbonized particles are compacted to a height of 5-25% of the total height between the cathode device shell and the cathode, wherein the layer of fine carbonized particles has a density of 250 to 600 kg/m$^3$.

2. A method for lining a cathode of a reduction cell for production of aluminum, the method comprising:

filling a bottom of a cathode device shell with a layer of fine carbonized particles;

filling and leveling a thermal insulation layer on the layer of fine carbonized particles;

filling, leveling and compacting a refractory layer; and installing bottom and side blocks followed by sealing joints therebetween with a cold ramming paste, wherein the fine carbonized particles are compacted to a height of 5-25% of the total height between the cathode device shell and the cathode, wherein the layer of fine carbonized particles has a density of 250 to 600 kg/m$^3$.

3. A method for lining a cathode of a reduction cell for production of aluminum, the method comprising:

filling a bottom of a cathode device shell with a layer of fine carbonized particles, wherein the fine carbonized particles consist of carbonized woodflour, carbonized hardwood sawdust, or carbonized softwood sawdust;

filling and leveling a thermal insulation layer on the layer of fine carbonized particles;

filling, leveling and compacting a refractory layer; and installing bottom and side blocks followed by sealing joints therebetween with a cold ramming paste.

* * * * *